United States Patent [19]

Kunczynski

[11] Patent Number: 4,860,664

[45] Date of Patent: Aug. 29, 1989

[54] HAUL ROPE GRIP ASSEMBLY FOR AERIAL TRAMWAY WITH ELASTIC BLOCK JAW ACTUATING MEANS

[75] Inventor: Jan K. Kunczynski, Boulder Cove, Nev.

[73] Assignees: Zygmunt A. Kunczynski; Alexander J. Kunczynski, both of Carson City, Nev.

[21] Appl. No.: 183,829

[22] Filed: Apr. 20, 1988

Related U.S. Application Data

[63] Continuation-in-part of Ser. No. 37,719, Apr. 13, 1987, abandoned, which is a continuation of Ser. No. 766,710, Aug. 19, 1985, Pat. No. 4,658,733.

[51] Int. Cl.[4] ..... B61B 12/12

[52] U.S. Cl. ..... 104/204; 104/211; 104/216

[58] Field of Search ..... 104/202, 204, 205, 208, 104/209, 211, 212, 214, 216, 217, 218, 222, 225

[56] References Cited

U.S. PATENT DOCUMENTS

| | | | |
|---|---|---|---|
| 585,873 | 7/1897 | Martin | 104/209 |
| 3,037,464 | 6/1962 | Penney et al. . | |
| 3,685,457 | 8/1972 | Wallmannsberger . | |
| 3,827,372 | 8/1974 | Laurent . | |
| 4,364,314 | 12/1982 | Gaudet . | |
| 4,658,733 | 4/1987 | Kunczynski . | |

FOREIGN PATENT DOCUMENTS

| | | | |
|---|---|---|---|
| 308544 | 10/1919 | Fed. Rep. of Germany . | |
| 542702 | 1/1932 | Fed. Rep. of Germany . | |
| 1131718 | 6/1962 | Fed. Rep. of Germany | 104/209 |
| 1453517 | 8/1966 | France . | |
| 2548615 | 7/1983 | France | 104/211 |

*Primary Examiner*—Robert B. Reeves
*Assistant Examiner*—Dean J. Kramer
*Attorney, Agent, or Firm*—Flehr, Hohbach, Test, Albritton & Herbert

[57] ABSTRACT

An aerial tramway grip assembly (21) including a gripping head (24) carrying a pair of opposed movable jaws (26, 27) for gripping a haul rope (23) and a resilient biasing assembly (37) biasing the jaws (26, 27) towards a closed position. The improvement in the grip assembly (21) is comprised of two pairs of opposed stationary gripping surfaces (41,42,43,44) positioned proximate the jaws (26,27) and positioned to cooperate with an opposed one of the jaws (26,27) to grip the haul rope (23) therebetween in the event of release of the gripping force provided by the other jaw. Additionally, resilient biasing is provided by two independent rubber blocks or cylinders (38,39) which bias each jaw (26,27) toward an opposed jaw and toward the opposed stationary gripping surface (41–44). The stationary gripping surfaces (41–44) additionally are oriented to be gravity biased into wedging engagement with the haul rope (23) so as to grip the haul rope (23) even in the event of failure of the movable jaws (26,27). The grip assembly (21) also includes jaw actuating levers (53,54) coupled to the movable jaws (26,27) and formed to move the jaws to an open position against the resilient biasing by the rubber cylinders (2,8,39).

13 Claims, 5 Drawing Sheets

HAUL ROPE GRIP ASSEMBLY FOR AERIAL TRAMWAY WITH ELASTIC BLOCK JAW ACTUATING MEANS

RELATED APPLICATIONS

This is a continuation-in-part application based upon co-pending U.S. patent application Ser. No. 06/037,719 filed Apr. 13, 1987, now abandoned, entitled "Aerial Tramway Gripp Asssembly and Method," which was a continuation application based upon co-pendingU.S. patent application Ser. No. 06/766,710, filed Aug. 19, 1985, entitled "Aerial Tramway Griip Assembly and Method," now U.S. Pat. No. 4,658,733, issued Apr. 21, 1987.

BACKGROUND OF THE INVENTION

In general, the present invention relates to aerial tramways, and more particularly, relates to detachable and permanent grip assemblies used to secure passenger or cargo carrier units of an aerial tramway to the haul rope.

As used herein, the expression "aerial tramway" shall be understood to include any haul rope based conveying system of the type having a plurality of passenger or cargo carrier units (chairs, gondolas, cabins, platforms, etc.) secured to a haul rope to enable those units to be conveyed along a path. Aerial tramway haul rope grip assemblies generally can be categorized into two groups, namely, detachable grip assemblies and permanently-affixed grip assemblies. "Detachable" grip assemblies include a grip actuating mechanism which can be operated at a tramway station to overcome gripping forces generated in the gripand release the grip for detachment from the haul rope. Detachable grips are removed regularly from the tramway haul rope to permit detachment of the carrier unit from the haul rope for loading and unloading of the passenger or cargo carrier units are tramway terminals or stations.

Permanently-affixed grip assemblies typically are used in aerial tramways, such as chair lifts and ski lifts. Although the permanently-affixed grips can be removed from the haul rope, they seldom are removed unless the grips are undergoing maintenance or repair. "Permanently-affixed" grip assemblies lack a machanism for release of the grip as the haul rope and passenger carrier units are advanced through the tramway loading and unloading stations.

The performance criteria for aerial tramway grip assemblies typically have been established by industry regulating bodies or the laws of various countries. In the United States, for example, the gripping force generated by a grip assembly must be at least three times that required to prevent slippage of the grip along the rope, and the grip must produce a 3% reduction in the rope area at the grip. Since rope manufacturers typically manufacture haul ropes to a nominal diameter plus 6% minus 3% along the rope length, detachable grip assemblies must be capable of meeting these performance criteria notwithstanding variation of the rope diameter along the length of the rope.

In recent years there also has been a trend in the aerial tramway industry to increase the uphill carrying capacity of tramways. This, in turn, has resulted in an increase in prime mover horsepower and a corresponding increase in haul rope diameter. Carrier units also have increased in capacity and, accordingly, weight. Thus, the rope gripping forces are now quite substantial and the problems attendant to detaching and attaching the carrier units from the rope are substantial. A gondola system having a spring-biased movable jaw may require, for example, 5000–6000 pounds of force to open the grip.

Accordingly, both permanently-affixed and detachable tramway grip assemblies must be made as fail-safe as possible, but the problems associated with making detachable grip assemblies fail-safe generally are greater than for permanently-affixed grip assemblies. The adverse environmental conditions in which tramways typically operate, plus the repeated need for opening and closing of the grips while heavily loaded, can result in fatiguing and failure of the detachable grip components, such as jaws, biasing springs and/or lever arms used to apply the gripping force to the jaws. Moreover, the increased loading of tramway systems makes grip failures potentially more catastrophic.

U.S. Pat. No. 3,037,464 to Penney, et al. is typical of a "permanently-affixed" grip assembly. The Penney, et al. grip includes a movable jaw which is biased toward a fixed jaw by two compression springs. The use of two independent springs to bias the same gripping jaw is broadly pertinent to the gripping assembly of the present invention in that such redundancy provides one form of fail-safe protection against grip release. If, for example, one of the two springs should fail, the remaining spring will still apply a gripping force to the haul rope. If either gripping jaw fails, however, the grip will release the haul rope.

In general, detachable tramway grip assemblies with their grip release mechanisms tend to be relatively complex. Detachable grips may have over 100 parts and require involved rail support structures at the tramway stations to support the grips as they are operated while moving with the haul rope. A typical detachable aerial tramway grip assembly will be sold at a price of $1500 to $1700 as a result of this complex structure. Since the number of grip assemblies in a system is large, the total cost of a tramway system is significantly increased by the grip assembly costs. Complex grip opening and closing grip support structures further increase the tramway system cost, and grip assembly complexity inherently increases repair and maintenance costs.

Typical of prior art detachable tramway grip assemblies currently in use are the grips shown in French Patent No. 1,453,517to Pomagalski and in U.S. Pat. No. 3,685,457 to Wallmannsberger. The Pomagalski grip assembly includes a fixed jaw and a movable jaw which is spring-biased toward the fixed jaw. An actuating lever is provided to overcome the spring force and permit opening of the grip assembly at the tramway terminals. The Pomagalski grip, however, requires a complex set of support rails to effect opening of the grip on the move, and if either gripping jaw should fail, the grip will release the haul rope. Since there are two biasing springs, this grip assembly does provide redundancy against the failure of one of the springs, but it is not fail-safe if either of the haul rope gripping jaws fail. Moreover, the entire gripping force is generated by the biasing springs.

In U.S. Pat. No. 3,685,457, to Wallmannsberger a grip assembly is disclosed in which two side-by-side movable jaws are spring biased toward a stationary jaw or surface to grip the haul rope therebetween. This detachable grip provides redundancy in that the two springs are independent of each other so that failure of one spring does not cause failure of the entire grip. As was the case in the Pomagalski grip, the gripping force in the Wallmannsberger grip is generated solely by the biasing springs. Thus, the stationary jaw or surface merely reacts to the gripping force generated by the movable jaw; the stationary jaw does not add to the gripping force on the haul rope. Moreover, failure of either jaw will release the gripping force on the haul rope.

German Patent No. 1,131,718 to Pohlig discloses a detachable tramway grip assembly which employs two opposed, movable, spring-biased gripping jaws. The gripping jaws are at one end of pivotally mounted levers while the biasing spring is proximate an opposite end of the levers. In one form of the Pohlig '718 grip, the two movable jaws cooperate with a stationary support surface to grip the haul rope. The Pohlig '718 grip assembly, however, is no failsafe. If either jaw, either-lever or the spring should fatigue and fail, the grip will release the haul rope. As is true of the Pomagalski grip, the entire gripping force in the Pohlig '718 grip assembly is generated by biasing spring.

U.S. Pat. No. 3,827,372 to Laurent is similar in structure to Pohlig '718 except that the two movable jaws are biased by torsion bars instead of a compression spring. The entire gripping force is generated by the torsion bars, and failure of a jaw or either torsion bar will cause failure of the grip.

German Patent No. 308,544 to Blerchert discloses several forms of detachable tramway grip assemblies. In each case, however, failure of the biasing spring, failure of either jaw, or failure of either lever on which the haul rope gripping jaws are carried, results in release of the gripping force and failure of the overall assembly.

Detachable aerial tramway grip assemblies also have been devised which employ opposed converging surfaces which are gravity biased to wedge against the haul rope and thereby effect gripping. One such prior art detachable grip assembly is shown in U.S. Pat. No. 4,364,314 to Gaudet. The Gaudet grip assembly does not employ movable spring biased jaws. Thus, all the gripping force is achieved through a wedging action. This approach poses problems as the carrier unit weight increases. Thus, unwedging of the grip from the haul rope can become difficult. Additionally, should either opposed surface of the haul rope gripping clips fatigue and fail, that clip will fail. Since there are two clips, the grip assembly does contain a degree of redundancy.

Finally, in German Patent No. 542,702, also to Pohlig, a grip assembly is disclosed in which the haul rope is engaged by two shoes which essentially ride the top of the haul rope. The shoes include two opposed cylinders with grooves that are skewed to match the lay of the haul rope strands. The Pohlig '702 grip is designed to permit free rotation of the haul rope about its longitudinal axis while gripped by the rotatable grooved cylinders. This grip assembly makes no use of a resiliently biased movable jaw as a part of the gripping mechanism, and any wedging or binding between grooved cylinders is minimal since the cable can rotate. Additionally, detachment of the grip assembly "can be accomplished smoothly and free of shocks," which suggests little or no wedging action.

OBJECTS OF THE INVENTION

Accordingly, it is an object of the present invention to providea detachable haul rope grip assembly for an aerial tramway which has a high degree of redundancy and accordingly is fail-safe under virtually all operating conditions.

Another object of the present invention is to provide a detachable aerial tramway grip assembly which is fail-safe and yet constructed with a minimum number of components for reliable operation.

A further object of the present invention is to provide a detachable aerial tramway grip assembly which will generate a substantial gripping force and accordingly is suitable for use with passenger or cargo carrier units having substantial weight.

Another object of the present invention is to provide a grip assembly for an aerial tramway or the like which is easy to operate and requires minimal grip actuating and supporting structures at each tramway station.

A further object of the present invention is to provide a haul rope grip assembly for an aerial tramway which is economical to manufacture, install and maintain.

Still a further object of the present invention is to provie a fail-safe, detachable haul rope grip assembly which is constructedso as to minimize the forces required to release and to actuate gripping of the haul rope.

Another object of the present invention is to provide a haul rope grip assembly which is durable, adaptable to a wide range of applications, and built to be relatively maintenance-free.

Still another object of the present invention is to provide a detachable haul rope grip assembly which has high strength, flexibility and reliability under varying temperature and moisture conditions.

The haul rope grip assembly of the present invention has other objects and features of advantage which will become apparent from and are set forth in more detail in the description of the Best Mode Of Carrying Out The Invention and the accompanying drawing.

DISCLOSURE OF THE INVENTION

The detachable haul rope grip assembly of the present invention includes a gripping head having at least one pair of opposed movablejaws, resilient biasing means biasing the jaws to a closed position to grip the haul rope, and jaw actuating means coupled to each of the movable jaws and formed for movement of the jaws from the closed position to an open position against said biasing means for detachment of the grip assembly. The improvement in the grip assembly which providesfail-safe operation comprises, briefly, the gripping head including a pair of stationary gripping surfaces positioned proximate the movable jaws and cooperating with the movable jaws to grip the cable in the event of release of the gripping force by one of the movable jaws; and the resilient biasing means provides two independent biasing forces to the jaws to bias the jaws toward each other and toward one of the opposed stationary gripping surface. Most preferably, the resilient biasing means is provided by two blocks of elastic material positioned for compressive loading between a portion of the head and a pair of levers on which the movable jaws are mounted. A further level of fail-safe redundancy is provided by forming the stationary gripping surfaces as converging surfaces oriented for gravity induced wedging of the grip onto the haul rope.

In another aspect of the present invention, the improvement in the grip assembly is comprised of providing movable jaw biasing means in the form of a block of elastic material which resiliently biases the movable jaws to a closed position.

BEST MODE OF CARRYING OUT THE INVENTION

Figure 1:
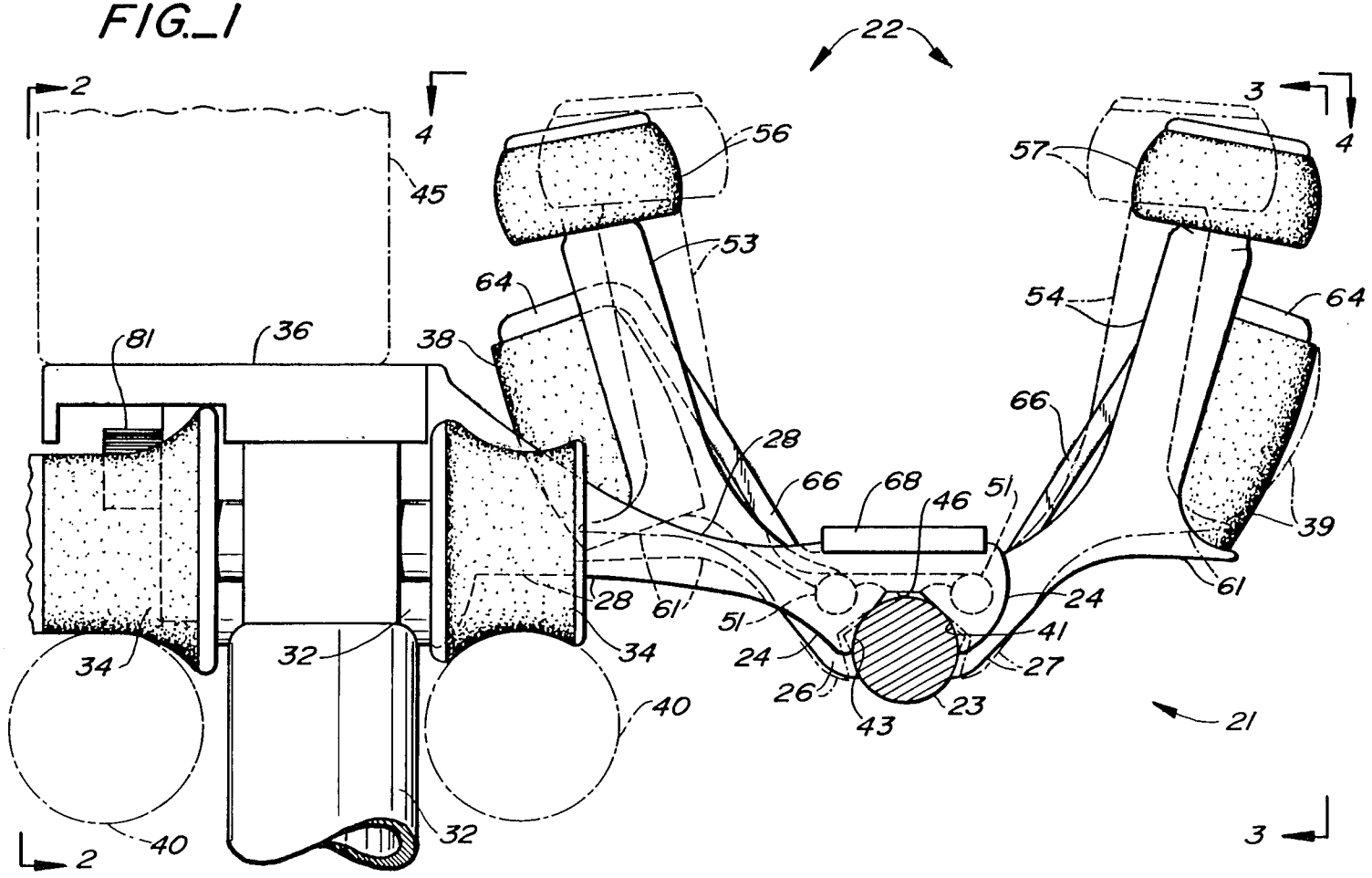
FIG. 1 is a front elevation view of a grip assembly constructed in accordance with the present invention with a moved position shown in phantom lines.

The aerial tramway grip assembly of the present invention is a detachable grip assembly, generally designated 21, which includes grip actuating means, generally designated 22, that may be operated to open the grip at tramway stations. Grip assembly 21 employs a simple construction with a very small number of components to generate high gripping forces on haul rope 23, while still providing a construction which includes several forms of redundancy that make the grip fail-safe under virtually all operating conditions.

Grip assembly 21 has a body comprised of a gripping head 24, laterally extending arm 28, and hanger arm assembly 29. Carried by head 24 are a pair of opposed movable jaws 26 and 27, which are mounted for selective movement between a closed position, shown in solids lines in FIGS. 1 and 5, and an open position, shown in phantom lines in FIG. 1. In the closed position, jaws 26 and 27 grip haul rope 23, while in the open position the jaws release the haul rope for detachment of the grip assembly from the haul rope. Haul rope 23 is schematically illustrated and typically is formed of a plurality of wires wrapped around a central core to form a cable or rope. Gripping jaws 26 and 27, therefore, engage the outer layer of wire around the haul rope periphery, and preferably over 180 degrees of the periphery to positively grip the haul rope.

Figure 2:
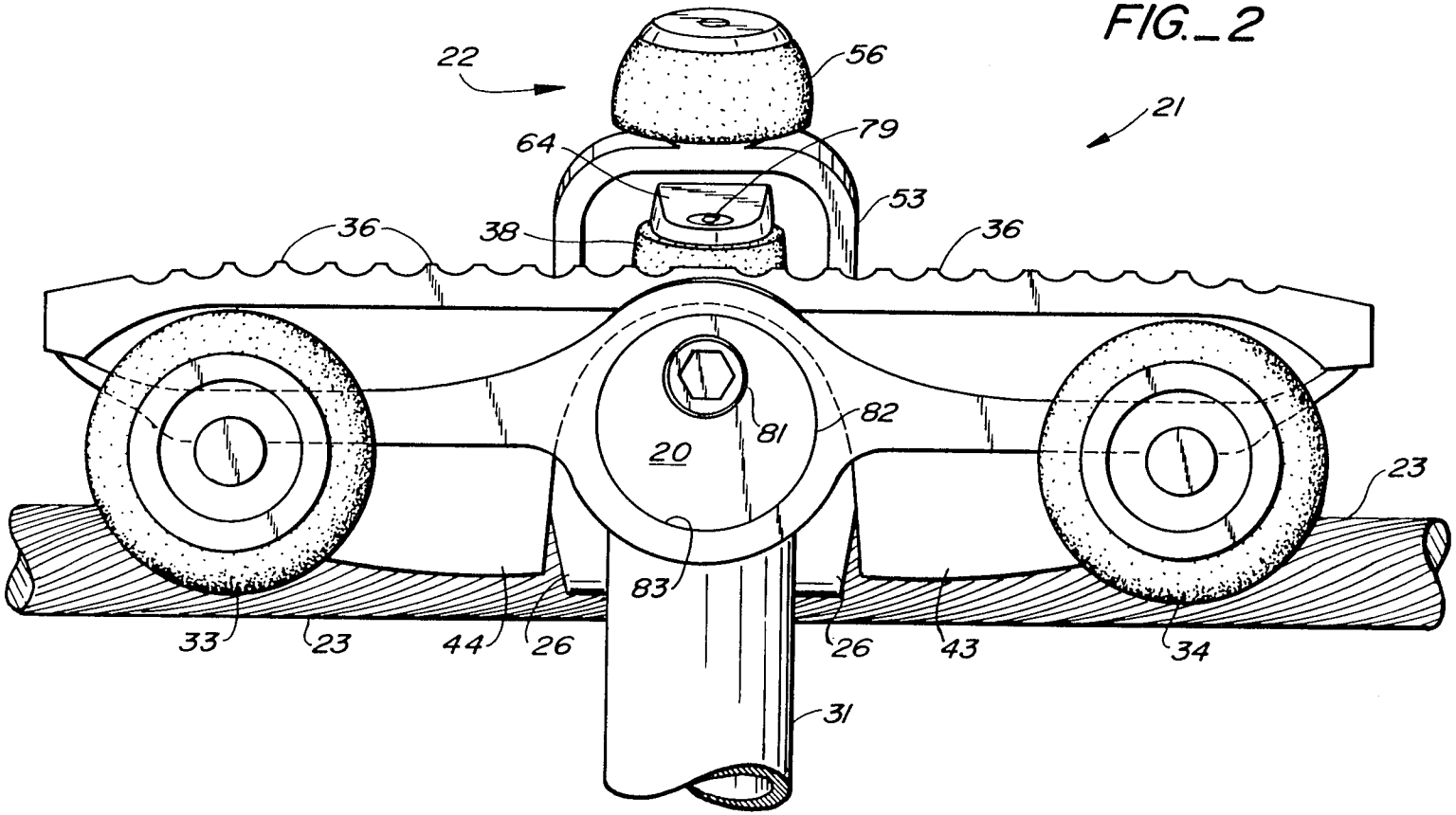
FIG. 2 is a side elevation view of the grip assembly of FIG. 1, taken substantially along the plane of line 2—2 in FIG. 1.

Arm 28 extends laterally from head 24 to hanger arm support assembly 29. As will be appreciated, there are a number of hanger arm mounting assemblies 29 which would be suitable for use with grip 21 of the present invention. The mounting of hanger arm 31 to hanger arm assembly 29 shown in the drawing can best be understood by reference to FIGS. 2 and 5. Hanger arm pipe 31 depends downwardly and is fixedly secured to sleeve member 32, for example, by welding. A passenger or cargo carrying unit (not shown) is mounted to the lower end of arm 31.

In order to permit rotation of hanger arm 31 about a horizontal axis perpendicular to haul rope 23, an end plug member 35 is mounted inside sleeve 32. Plug member 35 has an outwardly facing stepped flange 20 and has a bore 25 extending horizontally therethrough at an offset to the center of plug 35. Mounted through bore 25 is a fastener 81 which threadably engages a bore in back wall 80 of the hanger arm assembly housing. The periphery 82 mates with an opening 83 in the front wall of the assembly housing.

Sleeve 32, therefore, is able to rotate about the cylindrical body of plug 35, and a bushing, not shown, is preferably placed between plug 35 and sleeve 32 to permit rotation. Bolt or fastener 81 prevents rotation of the plug relative to the hanger arm house by reason of its eccenctric position relatie to the center of the plug.

Damping of the to-and-fro swinging of the hanger arm is provided by wave spring 84 which is positioned between the plug end flange and the end of sleeve 32. Additionally, a washer 86 is positioned next to wave spring 84 and a friction ring 87 is positioned between washer 84 and the end of sleeve 32. Mounted between the other end of sleeve 32 and backwall 80 of the hanger arm housing is a second friction ring 88.

As bolt or fastener 81 is tightened, the wave spring-washer-friction ring assembly is compressed, and the frictional damping of pivotal motion of the hanger arm around plug 35 is increased.

In order to support the grip assembly and the carrier unit at stations or tramway terminals when the grip is detached from the haul rope, hanger arm assembly 29 also includes two pairs of support rollers, namely, a front pair 34 on either side of the front of hanger arm support assembly 29 and a rear pair of rollers 33. As may be seen in phantom, rollers 33 and 34 rotatably engage rails or pipes 40 (shown in phantom in FIG. 1), for support of the carrier unit apart from haul rope 23. Additionally, the hanger arm support assembly includes an upwardly facing drive shoe surface 36, which may be engaged by rubber drive tires 45 (shown in phantom) at the terminal to propel the carrier unit along guide rails 40. The use of support rollers and drive shoes on tramway grip assemblies is well known in the art.

In order to bias jaws 26 and 27 toward the closed gripped condition, grip assembly 21 further includes resilient biasing means, generally designated 37, mounted to bias the jaws to the closed haul rope gripping position.

As thus far broadly described, the grip assembly of the present invention includes components found and well known in the detachable grip assembly art. Thus, there are movable jaws 26 and 27 which are biased to a closed position by biasing means 37, a hanger arm support assembly 29, and grip actuating means 22 which can be used to overcome the biasing force to move the movable jaws to the open position against the action of biasing means 37.

The present grip assembly, however, provides greatly enhanced redundancy and fail-safe operation as compared to prior detachable grip assemblies, while achieving this end by using a structure which has a minimum number of components. The fail-safe operation of grip assembly 21 is the result of builtin redundancy in three broad areas.

First, two independent biasing forces are provided by biasing means 37 to two independent movable jaws. Thus, biasing means 37 is here provided by two blocks of resilient, rubber-like material 38 and 39, which are mounted in compression so as to bias the independent jaws 26 and 27 toward the closed position. If either of rubber biasing spring members 38 or 39 should fail, the other member will still apply a biasing force to the other jaw.

Second, each of the movable jaws 26 and 27 is resiliently biased toward at least one opposed stationary gripping surface. In the present invention, each movable jaw is resiliently biased toward a pair of opposed stationary gripping surfaces. This provides redundancy against failure of either of the movable jaws or failure either of the independent biasing members 38 and 39.

The third form of redundancy is provided by forming the stationary gripping surfaces in gripping head 24 as converging surfaces which are gravity biased into wedging engagement with the upwardly facing side of the haul rop. Thus, if more than one movable jaw or more than one spring should fail, so that the gripping forces on both movable jaws are now relaxed, the converging stationary gripping surfaces will wedge against the upper side of haul rope 23 with sufficient wedging force to prevent sliding of the grip assembly along the haul rope, even in relatively steeply inclined haul rope sections. This wedging action, therefore, acts as a fail-safe feature against failure of both jwas, failure of one jaw and an opposing spring, as well as failure of both jaws or both springs.

The details of construction of grip assembly 21 and the manner in which it is operated by grip actuating mechanism 22 can now be described.

Figure 3:
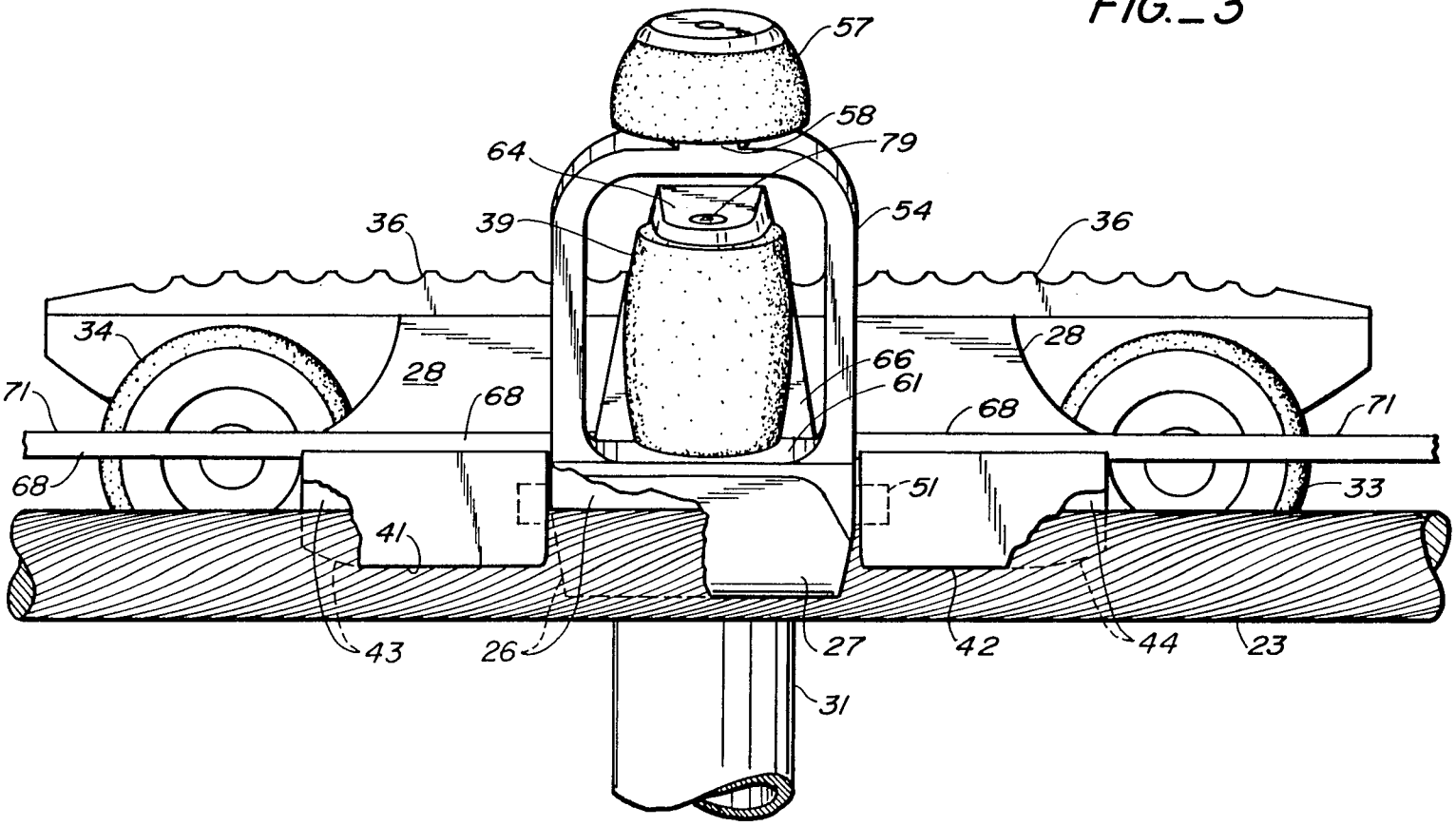
FIG. 3 is a side elevation view of the opposite side of the grip assembly of FIG. 1, taken substantially along the plane of line 3—3 in FIG. 1.

As can be seen in FIGS. 1 and 3, movable jaw 26 is opposed by a pair of stationary gripping surfaces 41 and 42 which engage cable 23 on a side opposite to the side engaged by movable jaw 26. Similarly, the pair of stationary gripping surfaces 43 and 44 oppose movable jaw 27. If jaw 27 fails, the haul rope will be gripped, for example, between unfailed jaw 26 and opposed stationary gripping surfaces 41 and 42. If jaw 26 fails, haul rope 23 will be gripped between jaw 27 and opposed stationary gripping surfaces 43 and 44.

Figure 4:
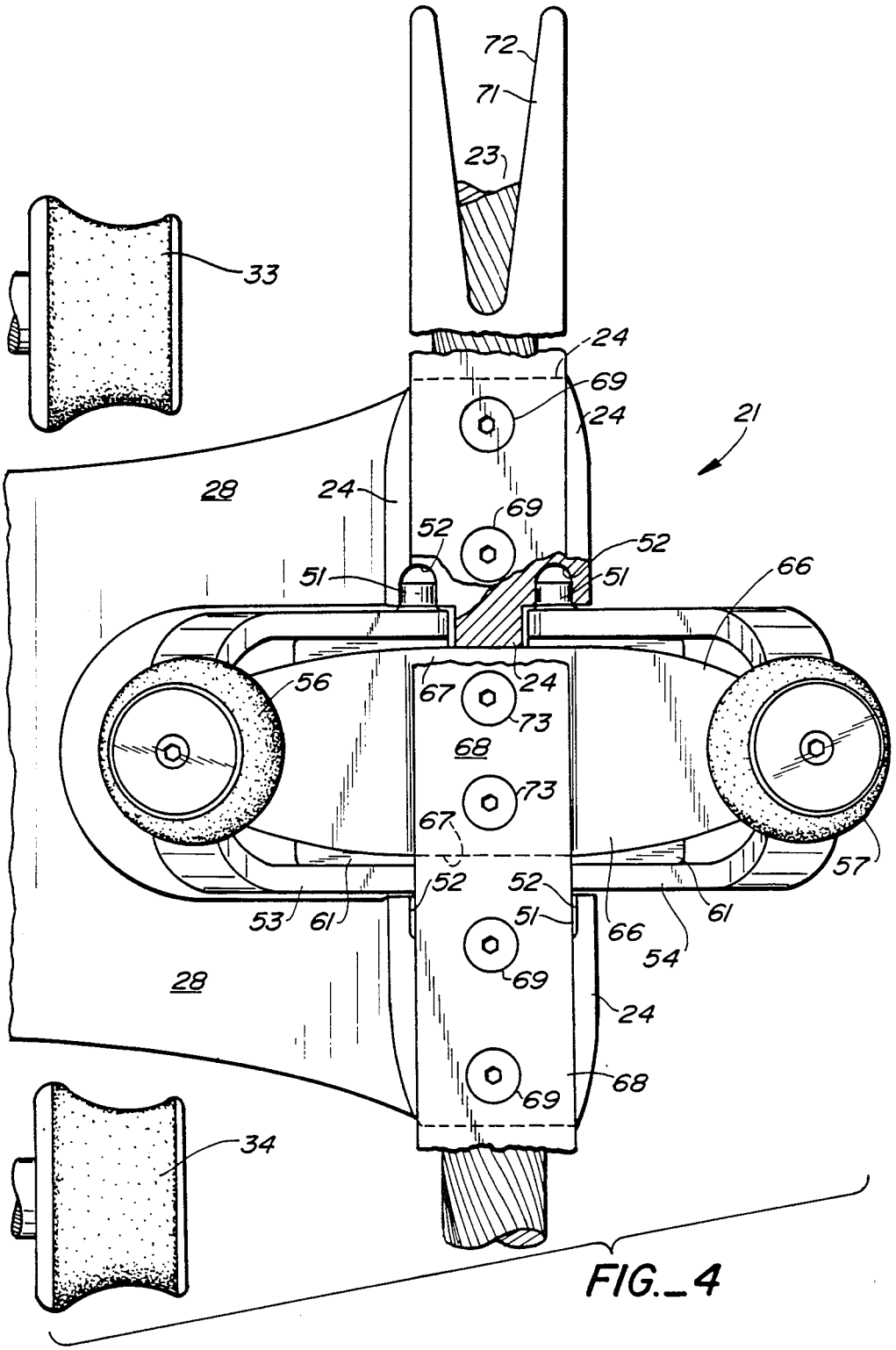
FIG. 4 is a fragmentary, enlarged, top plan view of the grip assembly of FIG. 1, taken substantially along the plane of line 4—4 of FIG. 1.
Figure 5:
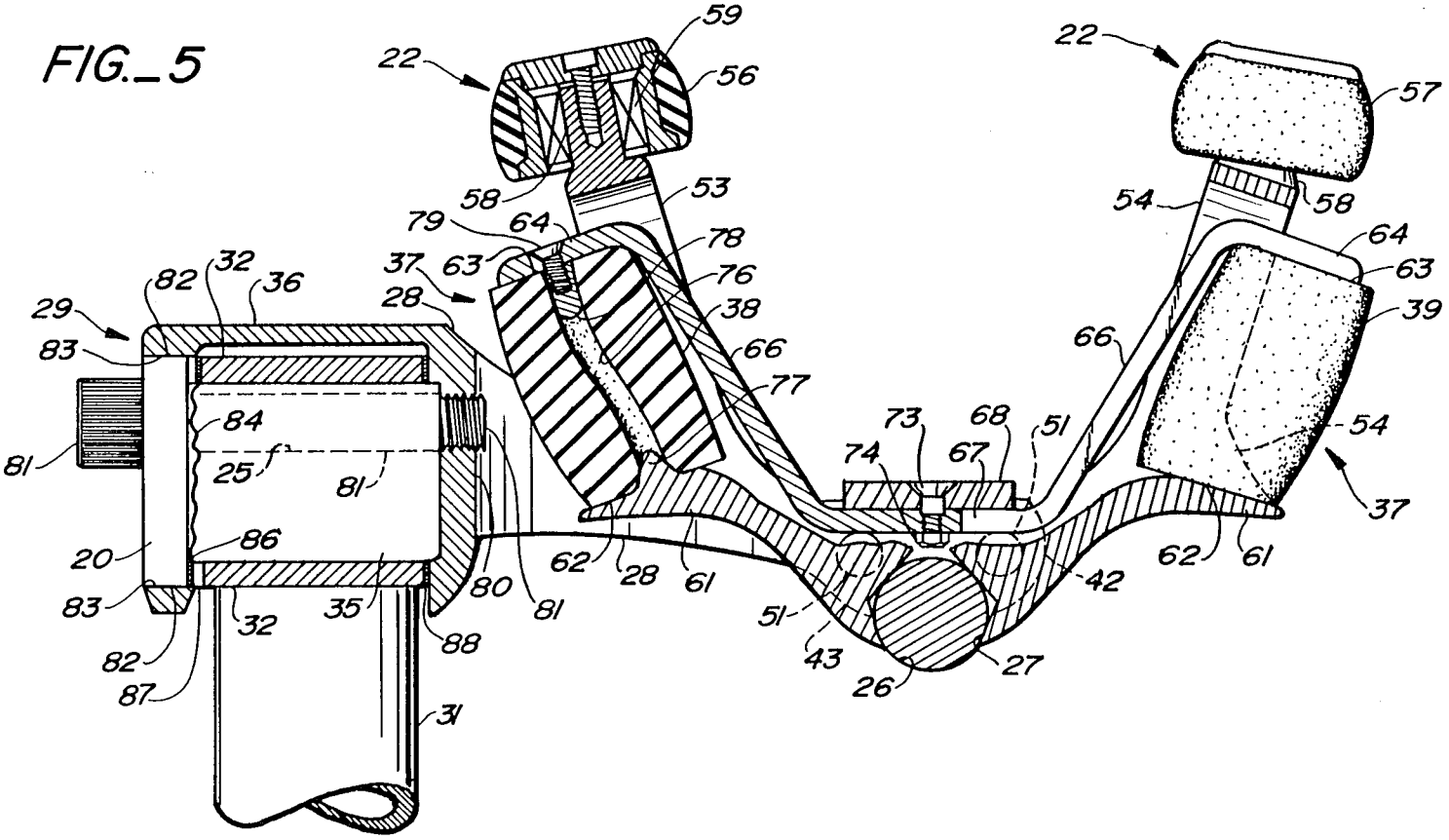
FIG. 5 is a front elevation view in cross-section taken substantially along the plane of line 5—5 in FIG. 2.

Each movable jaw 26 and 27 preferably is pivotally mounted to body 24, for example, by pivot pins 51 which are rotatably received in open-topped pockets 52 in body 24 of the gripping head (FIG. 4). In order to provide mechanical advantage for opening of the jaws, jaws 26 and 27 preferably are provided on the inner ends of outwardly and upwardly extending levers 53 and 55, which are advantageously be formed with O-shaped outer ends, as best seen in FIG. 3. Levers 53 and 54 each carry roller elements 56 and 57 mounted to the outer ends 58 of the levers for rotation on bearing means 59 (FIG. 5).

Roller means 56 and 57 rollingly engage stationary rails or cams that are positioned at the tramway terminals. Thus, as grip assembly 21 is advanced with the haul rope, roller elements 56 and 57 gradually engage the cam surfaces (not shown), which, in turn, urge the two roller elements 56 and 57 and levers 53 and 54 toward each other to the position shown in phantom in FIG. 2. This motion pivots jaws 26 and 27 about pins 51 from the closed position in which they grip haul rope 23 to the open position, in which they release the haul rope.

The use of cam surfaces or converging flanges to actuate tramway grip assemblies is well known in the art. The present grip assembly, however, is a construction which makes grip actuation much easier than prior art grip assemblies such as French Patent No. 1,453,517 to Pomagalski. The grip actuating means 22 allows equal and opposite actuating forces to be applied to rollers 56 and 57 so that opening of the grip assembly does not induce moments about the haul rope which require auxiliary support rails for the grip.

Resilient biasing of movable jaws 26 and 27 by the rubber-like blocks or springs 38 and 39 is accomplished by providing flange means 61 on the outer O-shaped ends of levers 53 and 54. Flange means 61 engages and supports a lower end 62 of the resilient biasing spring members 38 and 39. The upper ends 63 of rubber springs 38 and 39 are engaged by the outwardly extending arm ends 64 of U-shaped member 66. Member 66 is fastened at the center portion 67 to gripping head 24 and is cantilevered therefrom to provide support surfaces 64.

As best may be seen in FIG. 4, U-shaped support member 66 is mounted beneath a longitudinally extending plate 68, which passes over the top of the central portion 67 thereof. Plate 68 further extends on either side of support member 66 so that it may be secured by fasteners 69 to gripping head 24. The opposed ends 71 of plate 68 also may be advantageously formed with a V groove or slot 72 for alignment with cable 23.

Intermediate the end fasteners 69, which secure plate 68 to the gripping head, are a pair of fasteners 73 which pass through plate 68 and through center portion 67 of support member 66. In the center of gripping head 24, the two fasteners 73 are secured by nuts 74 (FIG. 5) so as to couple plate 68 and support member 66 together as a unit. There is not sufficient gripping head material to screw fasteners 73 directly into the gripping head, as is done in connecton with fasteners 69.

It should also be noted that plate 68 covers the grooves 52 which are open to the top of body 24 to receive pins 51 for levers 53 and 54. Pivot pins 51 are simply dropped into grooves52 and then plate 68 holds or captures the pins in grooves 52 so that they cannot escape. Once the resilient spring members 38 and 39 are in place, however, the force of the springs tends to urge the levers in a downward direction, which also insures that the pins 51 cannot escape the open top grooves 52.

In the preferred form, each of the rubber-like block members 38 and 39 is provided by a cylindrical rubber spring haing a central bore 76 (FIG. 5) into which a protrusion 77 from flange means 61 extends. At an upper end, a second protrusion 78 similarly extends into bore 76. The protrusion 78 is secured by fastener 79 which passes through the upper end 64 of cantilevered support arm 6. Protrusions 77 and 78, therefore, hold the rubber springs in alignment between flange 61 on the jaw levers and support member 66 from jaw head 24 for compressive loading of the springs therebetween.

One commercially available rubber spring which well suited for use with the grip assembly of the present invention are the rubber die springs manufactured by Firestone Industrial Products Company of Noblesville, Ind. and sold under the trademark MARSH MELLOW die springs. A MARSH MELLOW has a solid rubber core with a bore down the center and a bias-ply fabric wrap. Such spring will compress with much less center bulge than a conventional rubber block. Thus, they have greater stability and can be compressed to a greater degree.

A MARSH MELLOW die spring having a diameter of about two and one-half inches and a free length of about 5 inches with a center bore 67 of three quarters of an inch will provide sufficient gripping force (between about 1300 to 1700 pounds, depending on the haul rope diameter) between jaws 26 and 27 so that the movable jaws alone will grip haul rope 22 with sufficient force to meet aerial tramway grip standards with a safety factor of between 4 and 6.

Should either one of the rubber springs fail, the remaining spring will continue to urge the movable jaw to which it is mounted against haul rope which now will be supported by the opposed stationary gripping surfaces, instead of the opposed movable jaw. The clamping force between one movable jaw and the opposed stationary gripping surfaces will be reduced by about one-half, as compared to the force between two movable gripping jaws, but the gripping force will still meet the standards for aerial tramway grips.

It should be noted that U-shaped cantileveredsupport arm 66 is, in effect, a leaf spring which will deflect slightly under load. Leaf spring 66 acts in series with the rubber compression springs 38 and 39.

Typically, rubber springs 38 and 39 are compressed by approximately twenty percent of their free length when the jaws are in the closed position, so that approximately 1300 to 1700 pounds of force are applied by the jaws to the haul rope.

As the rubber springs are compressed further to open the jaws by levers 53 and 54, the force in the springs increases (e.g., to 2500 pounds). The lever arm between pivot pin 51 and rollers 56 and 57 is long enough to reduce the force required to open the grip to under 1000 pounds at the maximum opening.

The third area of grip redundancy is in the formation of stationary gripping surfaces 41–44 as surfaces which converge toward an apex or top area 46 that is positioned above the top side of haul rope 23. Thus, surfaces 41–44 are oriented for gravity biasing into wedging engagement with haul rope 23. This orientation of gripping surfaces 41–44 automatically gravity induces a gripping force of the stationary gripping surfaces against the haul rope. Such wedging action produces substantial haul rope gripping forces, without the need for any movable parts. As the included angle between opposed surfaces 41 and 43 or 42 and 41 becomes smaller, the gravity induced gripping forces from wedging between these surfaces increases. When the included angle between the opposed stationary gripping surfaces 41 and 43 or 42 and 44 reaches about 14 degrees, the haul rope will become wedged between the surfaces in a manner which is self-locking, that is, a force must be used to push the rope away from apex 46 of the converging surfaces. Above about 14 degrees the smooth steel surfaces 41–44 will not normally become locked down upon the steel strand comprising rope 23. Since assembly 21 is to be detachable, it is not normally desirable that the included angle between converging gripping surfaces be so small as to cause the assembly to be self-locking on the rope. Moreover, there is a plug 6 percent and minus 3 percent variation of the rope diameter, making it desirable in the detachable rope grip assembly of the present invention that surfaces 41–44 not converge at an angle less than about 114 degreesor an angle which would make the grip self-locking.

At the other extreme, it is preferable that the included angle between opposed surfaces 41 and 43 or 42 and 44 not be greater than about 90 degrees and preferably in the range of about 14–60 degrees. In a typical detachable grip constructed in accordance with the present invention, the included angle will be about 45 degrees with the weight of the passenger carrier being between 300 and 500 pounds. If the passenger carrier unit is loaded with four passengers having an average weight of 175 pounds, the total weight on the grip will be 1200 pounds and the gravity induced gripping force, F, on each of the surfaces would be over 1500 pounds or a total of 3000 pounds of gripping force. Under most operating conditions a 3000 pound gripping force would secure grip assembly21 to haul rope 23 in a manner which would prevent slippage of the grip assembly along the haul rope. Thus, gripassembly 20 is essentially fail-safe even if gripping jaws 26 and 27 should fail.

As will be seen, grip assembly 21 is formed of a relatively few number of components. The grip body, which includes head 24, arm 28, and hanger arm assembly 29 can all be cast from steel as a single piece. The two levers 53 and 54 with their O-shaped upper ends and gripping jaws 26 an 27 at the inner ends similarly can be cast steel members. Both the jaws and grip body are preferably cast ASTM-A148 steel having a tensile strength of about 125,000 psi. The cantilevered support arm or U-shaped leaf spring member 66 can be formed of a spring steel, heat treated to Rockwell C hardness of 38/40. Plate 68 is formed of a steel member, and the two rubber springs are MARSH MALLOW die springs. In addition, the grip incudes two roller assemblies for the actuating levers 53 and 54 and four rollrs on hanger arm assembly 29. The remaining components are essentially fasteners, such as the screws 69 and 71, the screws and end plates which mont the roller assemblies 56 and 57to the lever arms, and the bolt of fastener 81 on the hanger arm assembly 29.

What is claimed is:

1. In a detachable haul rope grip assembly for an aerial tramway, said assembly including a gripping head carrying a pair of opposed movable jaws mounted for selective movement between a closed position gripping said haul rope and an open position releasing said haul rope, resilient biasing means biasing said movable jaws toward said closed position and generating a gripping force between said jaws, and jaw actuating means coupled to said movable jaws and formed for movement of said movable jaws from said closed position to said open position against biasing of said biasing means, the improvement in said grip assembly comprising:

said gripping head including a pair of opposed stationary gripping surfaces positioned proximate said movable jaws, each one of said stationary gripping surfaces being positioned to cooperate with an opposed one of said movable jaws to grip said haul rope therebetween in the event of release of the gripping force provided by the other of said movable jaws; and said resilient biasing means generating two independent biasing forces and being mounted to and applying one of said independent biasing forces to each of said movable jaws to independently bias said movable jaws toward each other and toward an opposed stationary gripping surface.

2. The detachable grip assembly as defined in claim 1 wherein, said stationary gripping surfaces each engage opposite sides of said haul rope; and said resilient biasing means is provided by two independent biasing members.

3. The detachable grip assembly as defined in claim 2 wherein, said two independent biasing members are provided by two rubber-like blocks mounted for loading in compression.

4. The detachable grip assembly as defined in claim 1 wherein, said stationary gripping surfaces converge toward each other and are oriented in a direction for gravity wedging of said stationary gripping surfaces into engagement with said haul rope upon support of a load from said grip assembly.

5. The detachable grip assembly as defined in claim 1 wherein, said jaw actuating means includes a pair of levers pivotally mounted to said gripping head;

said movable jaws are provided by inner ends of said levers; and said biasing means is provided by a block of resilient rubber-like material mounted in compression between each of said levers and a support surface carried by said gripping head, said levers further compressing the blocks upon pivoting of said levers in a direction opening said jaws.

6. The detachable haul rope grip assembly as defined in claim 5 wherein, said levers are formed with O-shaped outer ends having opposed side portions spaced apart by a distance sufficient to receive a biasing means support arm between said opposed side portions of said O-shaped outer ends;

a roller element rotatably mounted to each of said outer ends of said levers for engagement with a lever displacing cam means at a tramway terminal to pivot said levers and open said movable jaws;

said gripping head includes a pair of stationary support arms cantilevered from said head and extending to a position inside said O-shaped outer ends of said levers to provide said support surface for said blocks; and said blocks are mounted between said support arms and said O-shaped outer ends of said levers for compression of said blocks upon pivoting of said levers in a direction moving said jaws toward an open position.

7. The detachable haul rope grip assembly as defined in claim 1 wherein, said gripping head further includes a second pair of opposed stationary gripping surfaces, said first pair of opposed stationary gripping surfaces being positioned proximate and on one side of said pair of opposed movable jaws and said second pair of stationary gripping surfaces being positioned proximate and on the other side of said pair of opposed movable jaws, each jaw of said movable jaws and the opposed stationary gripping surfaces cooperating to engage said haul rope circumferentially around more than 180°.

8. The detachable haul rope grip assembly as defined in claim 7, wherein, said biasing means is provided by two rubber-like block members mounted to independently bias each of said movable jaws toward said opposed stationary gripping surfaces so that failure of any one of said movable jaws, and said levers, and said block members will not result in failure of said grip assembly to grip said haul rope.

9. In a haul rope grip assembly for an aerial tramway, said assembly including a gripping head carrying at least one pair of opposed movable jaws mounted for cooperative gripping of said haul rope therebetween, jaw actuating means coupled to each of said movable jawas and formed for selective movement of said jaws between an open position and a closed position, the improvement in said grip assembly comprising:

said jaw actuating means including a block of resilient material mounted for three-dimensional deformation of a sufficient volume of sid block to resiliently bias said movable jaws towrd said closed position.

10. The haul rope grip assembly as defined in claim 9 wherein, each of said flange means includes a protrusion thereon extending in a direction toward said stationary support surface;

said stationary support surfaces are each provided by cantilevered springarms carried by said head and haaving protrusions extending toward said flange means; and said rubber-like block members are each formed with recesses in opposite end thereof dimensioned for an matingly receiving said protrusions on said flange means and said arms.

11. The haul rope assembly as defined in claim 10 wherein, each of said rubber-like block members is provided by a cylindrical member rubber core having a central bore extendingtherethrough to provide said recesses and an exterior wrapped wirh a bias-ply fabric.

12. In a haul rope grip assembly for an aerial tramway, said assembly including a gripping head carrying at least one pair of opposed movable jaws mounted for cooperative gripping of said haul rope therebetween, jaw actuating means coupled to each of said movable jaws and formed for selective movement of said jaws between an open position and a closed position, the improvement in said grip assembly comprising:

said jaw actuating means including a block of resilient material resiliently biasing said movable jaws toward said closed position, said block is provided by a cylindrical member having a central bore therethrough and wrapped with a bias-ply fabric wrap.

13. In a haul rope grip assembly for an aerial tramway, said assembly including a gripping head carrying at least one pair of opposed movable jaws mounted for cooperative gripping of said haul rope therebetween, jaw actuating means coupled to each of said movable jaws and formed for selective movement of said jaws between an open position and a closed position, the improvement in said grip assembly comprising:

said jaw actuating means including a block of resilient material resiliently biasing said movable jaws toward said closed position;

said jaw actuating means includes at least one pair of levers coupled to move said movable jaws with each of said levers carrying flange means thereon;

said gripping head carries a pair of stationary support surfaces positioned in opposed relation to said flange means, and said gripping head includes a pair of stationary gripping surfaces mounted proximate and in opposed relation to said movable jaws; and said block of resilient material is provided by a pair of rubber-like block members with one rubber-like block member mounted between each of said flange means and each of said stationary support surfaces for compressive loading thereof when either of said movable jaws move toward said open position.

* * * * *